US005369388A

United States Patent [19]

Manimalethu

[11] Patent Number: 5,369,388

[45] Date of Patent: Nov. 29, 1994

[54] LTC COMPENSATING WINDING FOR PARALLEL OPERATION OF TRANSFORMERS

[75] Inventor: Abraham I. Manimalethu, Muncie, Ind.

[73] Assignee: ABB Power T&D Company, Inc., Blue Bell, Pa.

[21] Appl. No.: 53,012

[22] Filed: Apr. 27, 1993

[51] Int. Cl.[5] ..... H01F 21/00

[52] U.S. Cl. ..... 336/145; 336/150; 336/170

[58] Field of Search ..... 336/145, 146, 147, 149, 336/150, 170, 180

[56] References Cited

U.S. PATENT DOCUMENTS 3,452,311 6/1969 Beck et al. ..... 336/70
3,611,224 8/1971 Becker ..... 336/5
3,611,228 8/1971 Walling ..... 336/70
3,621,428 11/1971 Johnson ..... 336/146
3,691,495 9/1972 Conway ..... 336/147
4,255,734 3/1981 Owen ..... 336/147

*Primary Examiner*—Leo P. Picard
*Assistant Examiner*—L. Thomas
*Attorney, Agent, or Firm*—Ostrolenk, Faber, Gerb & Soffen

[57] ABSTRACT

A winding configuration for a transformer equipped with a load tap changer which maintains an impedance balance when the transformer is connected in parallel with another transformer in the field. The winding configuration, from the core outward, consists of a first compensating winding, a low voltage (LV) winding, a load tap changer (LTC) winding, a high voltage (HV) winding, and a second compensating winding. If the impedance of the transformer has to be lowered to match the impedance of the existing unit in the field, the second compensating winding is coupled in series with the LV winding. If the impedance of the transformer has to be increased to match the impedance of the existing unit in the field, the first compensating winding is coupled in series with the LV winding.

3 Claims, 4 Drawing Sheets

FIG. 2 PRIOR ART

| ACTIVE TAP | VOLTAGES | FIGURE 1 IMPEDANCE | IMPEDANCE OF THE UNIT IN THE FIELD |
|---|---|---|---|
| NLTC #1 LTC BOOST | 562.5 KV-230 KV | 11.90 | 12.93(-7.97%) |
| NLTC #1 LTC NEUTRAL | 512.5 KV-230 KV | 12.48 | 11.52(+8.30%) |
| NLTC #1 LTC BUCK | 462.5 KV-230 KV | 13.60 | 13.49(+0.80%) |
| NLTC #2 LTC BOOST | 550.0 KV-230 KV | 11.68 | 12.48(-6.40%) |
| NLTC #2 LTC NEUTRAL | 500.0 KV-230 KV | 12.29 | 11.64(+5.58%) |
| NLTC #2 LTC BUCK | 450.0 KV-230 KV | 13.49 | 14.57(-7.40%) |
| NLTC #3 LTC BOOST | 537.5 KV-230 KV | 11.47 | 12.12(-5.36%) |
| NLTC #3 LTC NEUTRAL | 487.5 KV-230 KV | 12.10 | 11.92(+1.50%) |
| NLTC #3 LTC BUCK | 437.5 KV-230 KV | 11.68 | 15.93(-27%)* |
| NLTC #4 LTC BOOST | 525.5 KV-230 KV | 11.26 | 11.93(-5.60%) |
| NLTC #4 LTC NEUTRAL | 475.0 KV-230 KV | 11.94 | 12.39(-3.60%) |
| NLTC #4 LTC BUCK | 425.5 KV-230 KV | 11.50 | 17.82(-35%)* |
| NLTC #5 LTC BOOST | 512.5 KV-230 KV | 11.06 | 11.79(-6.20%) |
| NLTC #5 LTC NEUTRAL | 462.5 KV-230 KV | 11.78 | 13.08(-9.97%) |
| NLTC #5 LTC BUCK | 412.5 KV-230 KV | 12.15 | 19.95(-39%)* |

*IMPEDANCE IS OFF BY 27-39%

FIG. 4

| ACTIVE TAP | VOLTAGES | FIGURE 2 IMPEDANCE | IMPEDANCE OF THE UNIT IN THE FIELD |
|---|---|---|---|
| NLTC #1 LTC BOOST TB OUTER LV | 562.5 KV-230 KV | 11.90 | 12.93(-7.97%) |
| NLTC #1 LTC NEUTRAL TB OUTER LV | 512.5 KV-230 KV | 12.48 | 11.52(+8.30%) |
| NLTC #1 LTC BUCK TB OUTER LV | 462.5 KV-230 KV | 13.60 | 13.49(+0.80%) |
| NLTC #2 LTC BOOST TB OUTER LV | 550.0 KV-230 KV | 11.68 | 12.48(-6.40%) |
| NLTC #2 LTC NEUTRAL TB OUTER LV | 500.0 KV-230 KV | 12.29 | 11.64(+5.58%) |
| NLTC #2 LTC BUCK TB OUTER LV | 450.0 KV-230 KV | 13.49 | 14.57(-7.40%) |
| NLTC #3 LTC BOOST TB OUTER LV | 537.5 KV-230 KV | 11.47 | 12.12(-5.36%) |
| NLTC #3 LTC NEUTRAL TB OUTER LV | 487.5 KV-230 KV | 12.10 | 11.92(+1.50%) |
| NLTC #3 LTC BUCK TB INNER LV* | 437.5 KV-230 KV | 17.25 | 15.93(+8.25%)* |
| NLTC #4 LTC BOOST TB OUTER LV | 525.5 KV-230 KV | 11.26 | 11.93(-5.60%) |
| NLTC #4 LTC NEUTRAL TB OUTER LV | 475.0 KV-230 KV | 11.94 | 12.39(-3.60%) |
| NLTC #4 LTC BUCK TB INNER LV* | 425.5 KV-230 KV | 17.94 | 17.82(+0.67%)* |
| NLTC #5 LTC BOOST TB OUTER LV | 512.5 KV-230 KV | 11.06 | 11.79(-6.20%) |
| NLTC #5 LTC NEUTRAL TB OUTER LV | 462.5 KV-230 KV | 11.78 | 13.08(-9.97%) |
| NLTC #5 LTC BUCK TB OUTER LV* | 412.5 KV-230 KV | 18.00 | 19.95(-9.770%)* |

*IMPEDANCE MATCHED WITHIN 10%

LTC COMPENSATING WINDING FOR PARALLEL OPERATION OF TRANSFORMERS

BACKGROUND OF THE INVENTION

1. Field of the Invention

The present invention relates to transformers equipped with a load tap changer (LTC) and, more specifically, to the use of compensating windings in LTC-equipped transformers to increase or decrease the impedance of the transformer when the LTC changes position.

2. Description of the Related Art

When two transformers are connected in parallel, the impedances of the transformers must match (within 10%) to divide the load approximately equally between the two transformers or to divide the load according to the rating of each transformer. If the transformers to be connected in parallel are equipped with load tap changing windings, then the impedances for each of the tap changer positions must match. If these conditions are not met, then one of the transformers could conceivably carry a continuous overload, resulting in overheating.

Depending upon the insulation practice of the transformer manufacturer and the physical location of the load tap changer winding in relation to the core, the impedance can increase or decrease when the LTC changes position.

To date, no satisfactory solution has been provided to ensure that the impedance of a LTC-equipped transformer is appropriately increased or decreased when the LTC changes position to ensure that a load is properly divided between two parallel transformers.

SUMMARY OF THE INVENTION

The present invention overcomes the above-noted problem in the prior art by providing compensating windings in the circuit of a LTC-equipped transformer to increase or decrease the impedance of the transformer when the LTC changes position.

The winding configuration of the circuit of the present invention, from the core outward, consists of: a first compensating winding, a low voltage winding, a LTC winding, a high voltage winding and a second compensating winding.

If the impedance has to be lowered as the LTC changes position (to match or maintain the proper impedance in accordance with the other transformer), the second compensating winding is connected in series with the low voltage winding. If the impedance has to be increased as the LTC changes its position, the first compensating winding is connected in series with the low voltage winding.

Accordingly, using the circuit of the present invention, the impedance of an LTC-equipped transformer can be adjusted to any value for reliable parallel operation in the field with the transformers manufactured using different types of construction.

Other features and advantages of the present invention will become apparent when the following description of the preferred embodiment is read in conjunction with the accompanying drawings.

BRIEF DESCRIPTION OF THE DRAWINGS

FIG. 2 is a table showing the impedance of the winding arrangement of the conventional LTC-equipped transformer of FIG. 1 over various load conditions as compared to the impedance of a parallel unit in the field.

FIG. 4 is a table showing the impedance of the winding arrangement of the LTC-equipped transformer of FIG. 3 over various load conditions as compared to the impedance of a parallel unit in the field.

DETAILED DESCRIPTION OF THE PREFERRED EMBODIMENT

Figure 1:
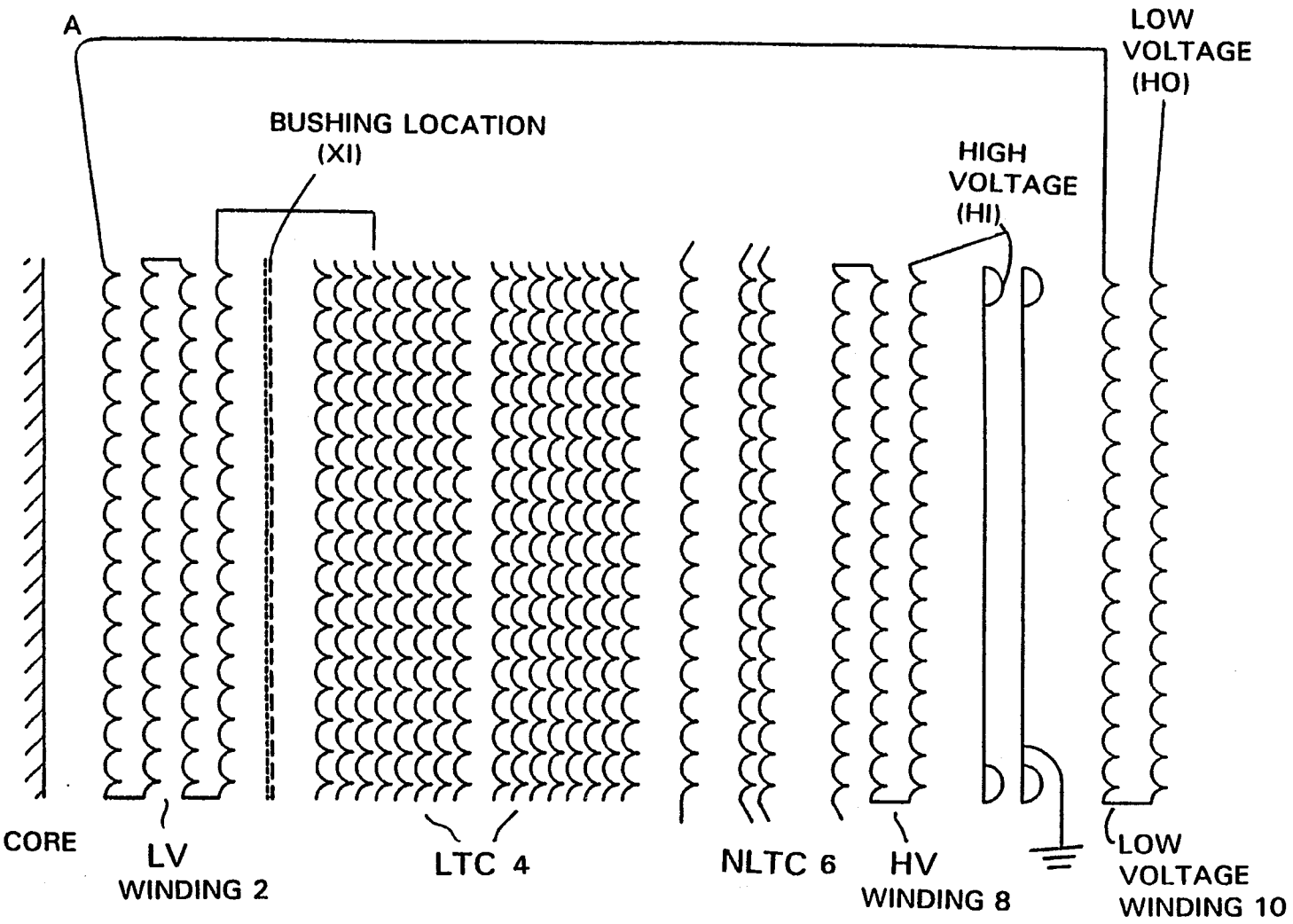
FIG. 1 PRIOR ART
FIG. 1 shows the winding arrangement of a conventional LTC-equipped transformer.

Referring first to FIG. 1, the winding arrangement of a conventional LTC-equipped transformer is shown. As shown in FIG. 1, a conventional LTC-equipped transformer consists, from the core outward, of low voltage (LV) winding 2, LTC 4, no load tap changer (NLTC) 6, high voltage (HV) winding 8, and an outer low voltage winding 10.

As is well known in the art, a LTC is designed to change the impedance of a transformer to accommodate and adjust for changes in voltage.

To decrease the impedance of a transformer the LTC automatically subtracts windings. Conversely, to increase the impedance of a transformer, the LTC automatically adds windings. As is well known in the art, the tap position in a LTC changes automatically (for example, from a neutral position to a boost or a buck position) while the system is operating (i.e., under load), while the tap position in a NLTC can only be changed manually when the system is turned off (i.e., under no load). In either case, the impedance of the transformer changes when the tap location of the LTC and/or NLTC changes.

As discussed previously, when transformers are connected in parallel, their impedances must match to ensure that neither transformer is subject to an overload. This presents a problem with an LTC transformer, since its impedance varies.

Thus, as shown in FIG. 2, for a NLTC winding #5, the impedance of the transformer in the field will vary from 11.79 to 13.08 to 19.95 depending upon whether the LTC is in the boost (increased turns), neutral (same turns) or buck (decreased turns) position, while the impedance of the LTC transformer of FIG. 1 will only vary from 11.06 to 11.78 to 12.15, respectively. In such a case, the impedance of the LTC transformer is, respectively, 6.20%, 9.97%, and 39% less than the impedance of the transformer in the field. Since an impedance difference of more than 10% can cause an overload, this situation is very undesirable.

Likewise, as shown in FIG. 2, when the LTC transformer is in the buck position for a NLTC #3 or a NLTC #4, the impedance of the LTC transformer differs from the impedance of the unit in the field by more than 20%.

Figure 3:
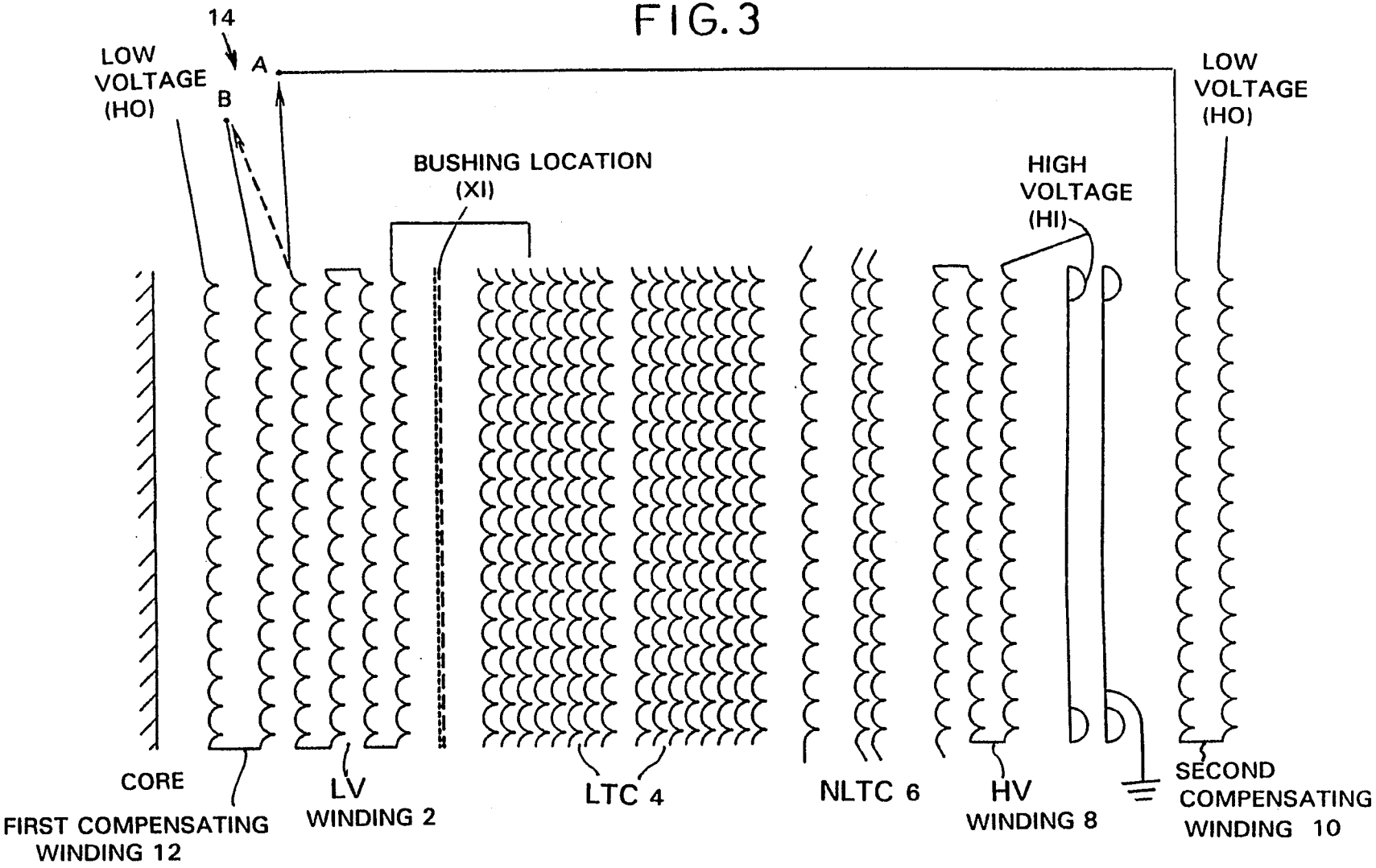
FIG. 3 shows the winding arrangement of the LTC-equipped transformer of the present invention, including compensating windings.

The winding arrangement of the LTC transformer of the present invention, shown in FIG. 3, overcomes the above-noted problem. As shown in FIG. 3, in the arrangement of the present invention, an additional inner LV winding, i.e., a first compensating winding, identified by reference numeral 12, is provided. Under normal conditions, first compensating winding 12 is not coupled to the circuit. Instead, as shown in FIG. 3, a switch 14, in position A, couples a second compensating winding, corresponding to outer LV winding 10 of the prior art circuit shown in FIG. 1, in series with LV winding 2, providing a low-high-low configuration, resulting in a low impedance.

Under certain conditions, where necessary, switch 14 is moved to position B, whereby first compensating winding 12 is coupled in series with LV winding 2, and second compensating winding 10 is disconnected from the circuit, providing a low-high configuration, resulting in a higher impedance.

Thus, referring to FIG. 4, the impedance of the LTC transformer can be boosted by moving switch 14 to position B when using NLTC #3, NLTC #4, and NLTC #5 with the LTC in the buck position, thereby keeping the impedance of the LTC transformer within 10% of the impedance of the parallel unit in the field under these conditions. Under all other conditions, the switch is set to position A, resulting in the configuration of the prior art circuit of FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

As is well known in the art, the tap position in a LTC changes automatically (for example, from a neutral position to a boost or a buck position) while the system is operating (i.e., under load), while the tap position in a NLTC can only be changed manually when the system is turned off (i.e., under no load). In either case, the impedance of the transformer changes when the tap location of the LTC and/or NLTC changes.

What is claimed is:

1. A winding configuration for a transformer mounted on a core, comprising, from the core outward:

(a) a first low voltage compensating winding;

(b) a low voltage winding;

(c) a load tap changer;

(d) a high voltage winding disposed in Series with and on the outside of said changer with respect to the core;

(e) a second low voltage compensating winding; and (f) a switch for coupling said first low voltage compensating winding in series with said low voltage winding to increase the impedance of the transformer, and for disconnecting said first low voltage compensating winding from said low voltage winding and coupling said second low voltage compensating winding in series with said low voltage winding to decrease the impedance of the transformer.

2. A method for adjusting the impedance of a transformer mounted on a core and equipped, from the core outward, with a low voltage winding, a load tap changer, and a high voltage winding disposed in series with and adjacent to said load tap changer, said method comprising the steps of:

coupling a first low voltage compensating winding disposed between the core and the low voltage winding in series with the low voltage winding of said transformer to increase the impedance of said transformer, and coupling a second low voltage compensating winding disposed outside of the high voltage winding with respect to the core in series with the low voltage winding to decrease the impedance of said transformer.

3. A method as recited in claim 2, wherein said step of coupling either said first compensating winding or said second compensating winding in series with said low voltage winding of said transformer is carried out by moving a switch from a first position to a second position.

* * * * *